US006099369A

United States Patent [19]

Puzey

[11] Patent Number: 6,099,369

[45] Date of Patent: Aug. 8, 2000

[54] WATER VEHICLE

[76] Inventor: Michael Roydon Puzey, Unit 136 Strijdom Industrial Park Hammer Avenue, Strijdom Park Randburg, South Africa

[21] Appl. No.: 09/125,045

[22] PCT Filed: Feb. 12, 1997

[86] PCT No.: PCT/GB97/00382

§ 371 Date: Aug. 12, 1998

§ 102(e) Date: Aug. 12, 1998

[87] PCT Pub. No.: WO97/29010

PCT Pub. Date: Aug. 14, 1997

[30] Foreign Application Priority Data

Feb. 12, 1996 [ZA] South Africa ..... 96/1095

[51] Int. Cl.[7] ..... B63H 16/00

[52] U.S. Cl. ..... 440/21; 440/14; 114/274

[58] Field of Search ..... 440/14, 15, 21, 440/22; 114/274, 275, 276, 279, 280, 281, 282

[56] References Cited

U.S. PATENT DOCUMENTS

| | | | |
|---|---|---|---|
| 3,718,109 | 2/1973 | Skitsko | 440/22 |
| 4,100,876 | 7/1978 | Felews . | |
| 5,816,871 | 10/1998 | Proverbio | 440/22 |

FOREIGN PATENT DOCUMENTS

| | | |
|---|---|---|
| 2563800 | 11/1985 | France . |
| 2697794 | 5/1994 | France . |
| 441916 | 1/1936 | United Kingdom . |
| 1134011 | 11/1968 | United Kingdom . |
| 2117712 | 10/1983 | United Kingdom . |

OTHER PUBLICATIONS

"Tragflüelboote Entwichlung, Theorie Und Anwendung" Von Schertel, VD1–Verlag GmbH, pp. 1–12.

*Primary Examiner*—Ed Swinehart

*Attorney, Agent, or Firm*—Jones, Tullar & Cooper, P. C.

[57] ABSTRACT

A water vehicle includes at least first and second foils which are at least partially submersible in water. These foils are movable, at least to a limited extent relative to each other. Repeated movement of the foils generates a propelling force that will move the water vehicle on the body of water.

21 Claims, 3 Drawing Sheets

FIG. 2
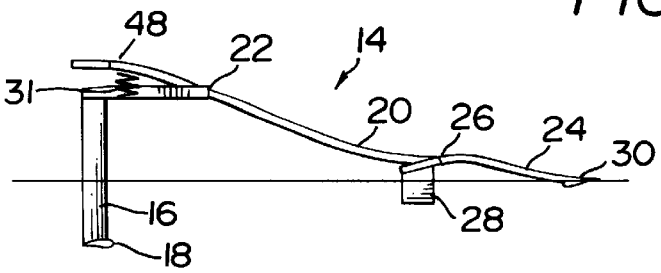
FIG. 3
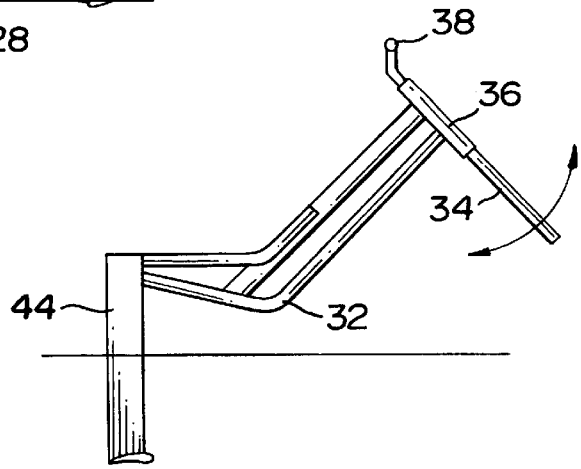
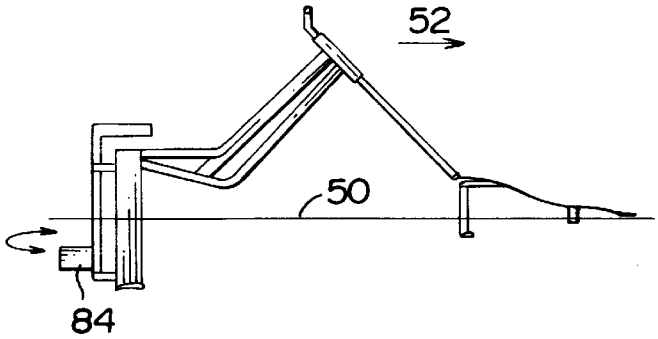
FIG. 4
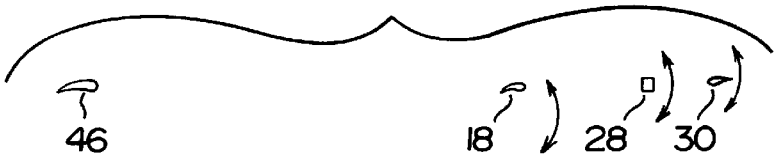
FIG. 5
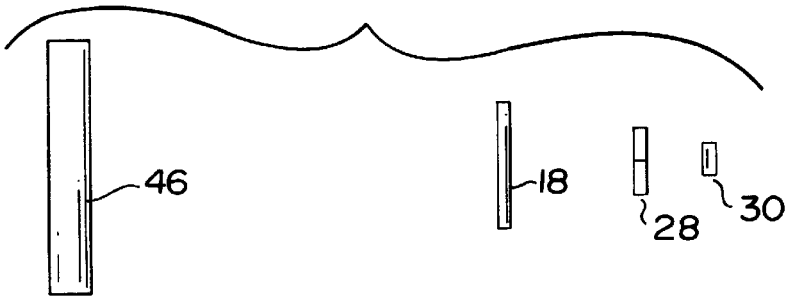
FIG. 6

WATER VEHICLE

FIELD OF THE INVENTION

This invention relates to a water vehicle.

SUMMARY OF THE INVENTION

According to one aspect of the invention there is provided a water vehicle which includes first and second foils which are at least partly submersible and which are movable, at least to a limited extent, relatively to each other.

The relative foil movement may cause, or be due to, at least one of the following: at least limited rotational movement of the first foil about an axis which is transverse to a longitudinal axis of the first foil; a variation in the inclination of the first foil about an axis which may extend generally in a direction which is parallel to the longitudinal direction of the first foil.

The water vehicle may include water skimmer means and connection means which is mounted for pivotal movement about an axis and which connects the skimmer means to the first foil.

The water vehicle may include a third foil which is at least partly submersible and which is connected by means of the connecting means to the skimmer means.

The water vehicle may include a support stucture and means securing the foils to the support structure, the said-relative foil movement being due to or caused by at least one of the following: relative movement between at least two sections or components of the support structure; relative movement between the support structure and the securing means; relative movement between at least one foil and the support structure; relative movement between at least one foil and the securing means.

The water vehicle may include biasing means which, at least to a limited extent, dampens the said relative foil movement. The biasing means may take on any suitable form and may, for example, include a resiliently deflectable or deformable member, a spring, a shock absorber mechanism, or the like.

The force which is exerted by the biasing means may be adjustable in order to vary the characteristics of the water vehicle.

According to a different aspect of the invention there is provided a water vehicle which includes a support structure, at least first and second foils which are at least partly submersible and which are secured to the support structure, means which permits limited movement of the first foil relatively to at least part of the support structure, and steering means for controlling the direction of movement of the vehicle.

The steering means may comprise rudder means of any suitable type, or means for causing at least limited rotational or pivotal movement of the first foil relatively to the second foil.

The aforementioned support structure, which may be in the form of a frame, may include a platform or the like in order to provide support for a user. The user may stand on the platform which may include feet engaging formations such as straps or the like. The frame may be made from any suitable material such as aluminium, a composite material such as fibre reinforced resin or the like, or be moulded from suitable material such as a pressure moulded plastics material.

The foils may be similarly formed and, according to a preferred aspect of the invention, the foils are formed from extruded or pultruded sections of a suitable material, e.g. aluminium, or are pressure moulded from a suitable plastics material.

The invention also provides a method of propelling a water vehicle which includes the steps of at least partially submerging at least first and second foils of the vehicle in a body of water, and repeatedly varying the inclination of the first foil in the body of water.

The surface of the body of water may be contacted by skimmer means which may be used to control the depth to which the first foil is submerged in the body of water.

The method may include the additional step of repeatedly varying the inclination of a third foil, which is at least partly submerged in the body of water.

BRIEF DESCRIPTION OF THE DRAWINGS

The invention is further described by way of examples with reference to the accompanying drawings in which:

FIG. 2 is a side view of a canard arrangement used in the vehicle of FIG. 1;

FIG. 3 is a side view of a support structure or frame used in the vehicle of FIG. 1;

FIG. 4 is a side view of the vehicle shown in FIG. 1;

FIG. 5 is a schematic side view of foils of the water vehicle of FIG. 1;

FIG. 6 is a plan view of the foils shown in FIG. 5;

DESCRIPTION OF PREFERRED EMBODIMENTS

Figure 1:
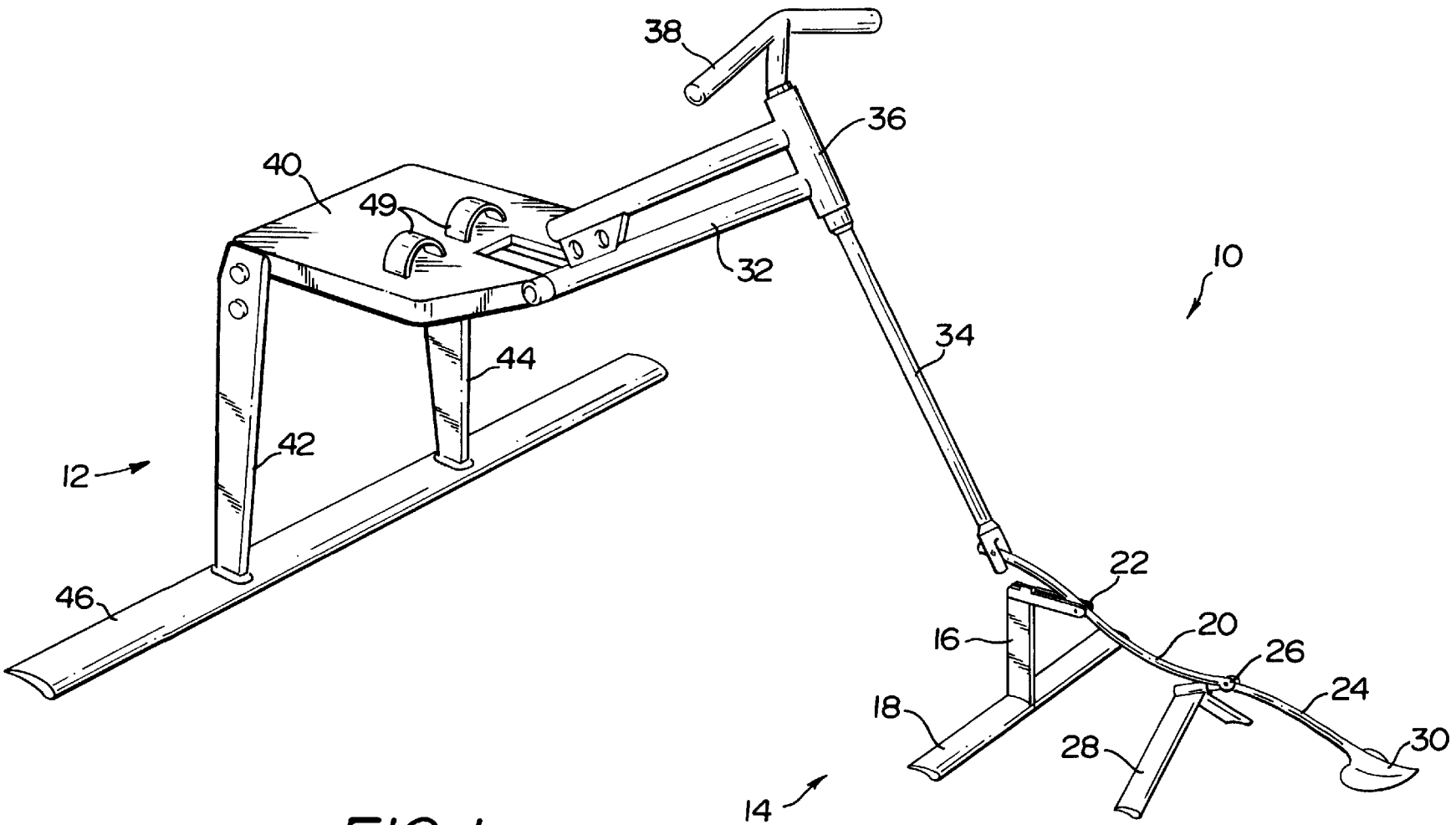
FIG. 1 is a perspective view of a water vehicle according to one embodiment of the invention.

FIG. 1 of the accompanying drawings illustrates a water vehicle 10 which includes a support structure or frame 12 and a canard arrangement 14.

The canard 14 is shown from the side in FIG. 2. It includes a support 16 to which is attached a transversely extending longitudinal leading foil 18, a lever 20 which is secured at a pivot point 22 to the support 16, an arm 24 which is attached at a pivot point 26 to the lever 20, a transversely extending V-shaped foil 28 which is secured to the arm 24, and a skimmer plate 30 at a forward end of the arm 24. A spring 31, optionally of variable stiffness, can be used to dampen movement between the support 16 and the lever 20.

The support structure or frame 12 is shown in a perspective view in FIG. 1, and from the side in FIG. 3. It includes a tubular frame assembly 32, a forwardly extending steering rod 34 which is mounted for rotation in a sleeve 36 of the frame assembly 32 and which is movable by means of a handlebar 38, a plafform 40 on the frame assembly, two downwardly extending support members 42 and 44 respectively, and a trarsversely extending longitudinal trailing foil 46 which is secured to the support members 42 and 44.

The support structure and the foils may be made from any suitable material. Use may for example be made of light weight composite materials such as carbon fibre, fibre glass or the like, or of light weight metals such as aluminium. It is also possible to form the various components by means of injection moulding processes.

The steering rod 34 is attached to the lever 20 of the canard arrangement at a pivot point 48. Referring to FIG. 2 it can be seen that this point is slightly in front of an upright portion of the support 16.

The platform 40 is adapted to support a user and, for this purpose, locating straps 49 may be provided on the platform to receive the feet of the user. The user is able to grip the handlebar 38. By turning the handlebar 38 the steering rod 34 can be rotated so that, viewed in plan the leading foil 18 and the V-shaped foil 28, together with the skimmer 30, are rotatable, or pivotable, relatively to the trailing foil 46. This type of movement is shown, somewhat schematically, in FIG. 6.

The foils 46, 18 and 28 are, in use, submerged in a body of water, not shown. In FIG. 4 the water line is indicated by the numeral 50. The skimmer 30 essentially rides on the surface of the water.

If the user has an initial forward velocity, in the direction of arrow labelled 52 in FIG. 4. then due to hydrodynamic effects lift is exerted on the foils with a magnitude which is sufficient to prevent the water vehicle from sinking into the water. By bobbing slightly up and down on the platform the user causes the orientations of the foils in the water to change relatively to one another. In particular, as is shown schematically in FIG. 5, the inclinations of the foils 18 and 28 are varied, relatively to the inclination of the trailing foil 46. Due to principles which are known in fluid dynamics the forward speed of the vehicle is maintained or increased. Effectively therefore the bobbing movement of the user is translated into forward movement of the vehicle and this in turn provides lift which is exerted on the foils and which ensures that the vehicle and the user do not sink into the water.

The force on the canard 14 is applied in front of the foil 18. This causes a slight, yet stable, variation in the inclination of the foils 18 and 28.

The foremost foil 28 is V-shaped to ensure that its wake does not interact with the downwardly extending support 16.

The user is able to vary the force exerted by the user's legs on the platform relatively to the force which is exerted by the user through the user's arms on the handlebar 38. In this way the user can simultaneously generate thrust on the foil 46 and on the foil 18, with the amount of thrust, in each case, depending on requirement and ability.

The relative movement between the various foils is made possible, in this instance, by the pivot connections at the points 22 and 48. This relative movement can be damped, as has been indicated, by making use of springs, rubber bushes or any equivalent mechanism, located at a suitable position between the foils.

Steering of the vehicle is effected, as has been explained, by rotating the steering rod 34 about its longitudinal axis.

Figure 7:
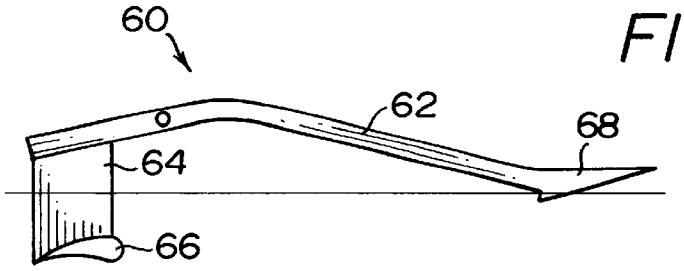
FIG. 7 is a view similar to FIG. 2 of a canard arrangement according to a variation of the invention.

FIG. 7 shows a canard arrangement 60 according to a variation of the invention. This arrangement includes a lever 62, a downwardly depending support 64 to which is attached a longitudinally extending foil 66, and a skimmer plate 68 at a forward end of the lever. This arrangement is substantially the same as the leading portion of the canard arrangement shown in FIG. 2.

Figure 10:
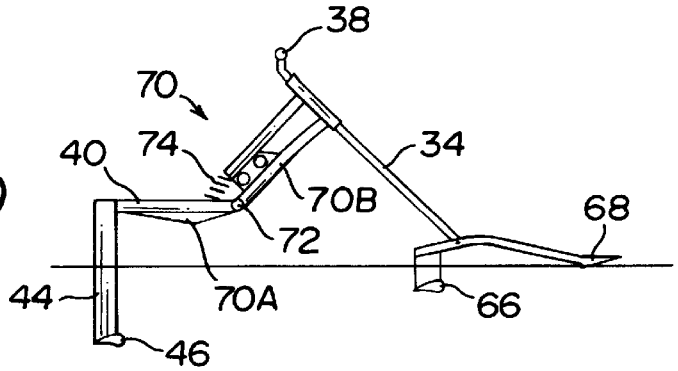
FIG. 10 is a side view, similar to FIG. 4, of a water vehicle which includes to canard arrangement of FIG. 7 and the support structure shown in FIG. 8.

FIG. 10 illustrates the arrangement 60 secured to a steering rod 34 of a support frame 70, which, in many respects, is similar to the support frame 12 shown in FIG. 1. Similar numerals have been employed in FIG. 10 to indicate similar components. Thus the support structure has a platform 40, downwardly depending support members 42 and 44, and a trailing foil 46.

It is necessary, in order to maintain thrust and achieve lift for the vehicle, that relative movement should take place between the leading foil 66 and the trailing foil 46. This may be achieved in various ways. It is pointed out, in connection with the FIG. 1 embodiment, that relative movement is achieved by means of the pivot connections 48 and 22. An equivalent type of movement can be achieved in other ways.

Figure 8:
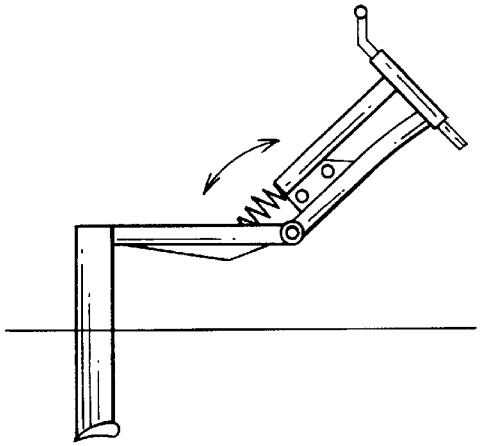
FIGS. 8 and 9 are side views of different support structures according to variations of the invention.

Referring to FIG. 10 the support structure, which is also shown in FIG. 8, includes two sections designated 70A and 70B respectively. These are connected to one another at a pivot point 72. The section 70A supports the platform 40 while the section 70B has the steering arrangement attached to it. A small degree of pivotal movement of one section can take place relatively to the other section. A compression spring 74 interconnects the two sections. The stiffness of the spring can be adjusted by compressing the spring to a greater or lesser extent using a suitable scew mechanism. Thus, when a user bobs up and down on the platform 40, relative movement between the foils takes place with the degree of relative movement depending, at least to some extent, on the stiffness of the spring.

With the arrangement shown in FIG. 10 thrust is generated primarily by the trailing foil 46 while the leading foil 66 acts as a stabilizer but, on the other hand, gives rise to drag. The arrangement shown in FIG. 10 is therefore less efficient than the arrangement shown in FIG. 1 in which both foils are used to generate thrust.

As is the case with the FIG. 1 embodiment the skimmer plate 68 imparts further stability to the arrangement and ensures that the foil 66 does not sink too deep into the water as forward movement of the vehicle takes place.

As an alternative to hinging two sections of the support structure to one another the structure 70 could be made relatively rigid and the steering rod 34 could be resilient or flexible to some extent. Again, with bobbing movement of the user on the platform 40, different amounts of force are exerted on the two foils and relative movement between the foils takes place as the rod 34 flexes. This permits the inclination of the foils to be varied and, in accordance with the principles which have been outlined hereinbefore, at least the rear foil 46 generates thrust which maintains the forward speed of the vehicle and which in turn ensures that lift is generated which prevents the vehicle from sinking into the water.

Figure 9:
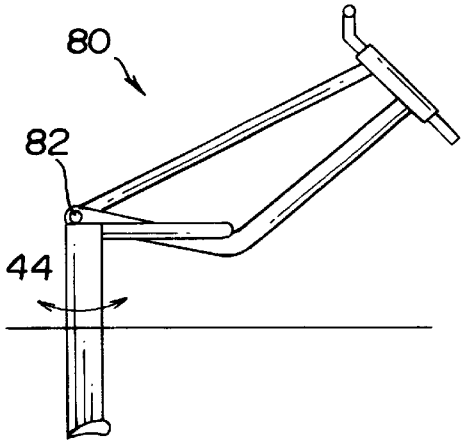

FIG. 9 shows support structure 80 according to a variation of the invention. Again like reference numerals have been employed to designate like components. In this case a degree of relative movement between the trailing foil 46 and the support structure is permitted by mounting the support members 42 and 44 to the support structure at hinge or pivot points 82. These points could include torsion mounts such as rubber axles or, alternatively, the degree of relative movement could be constrained by making use of biasing members similar to what is shown in FIGS. 8 and 10.

It is apparent that it is possible to permit the angular orientation of one foil to be varied relatively to the orientation of the other foil or foils, in a variety of ways. For example the entire support structure may be formed from a suitable flexible material. One could also make use of elastic bushes or mounts which secure the foils, or structure which supports the foils, to the support structure 70.

The degree to which the foils can move relatively to one another is important and this is determined by trial and experiment and by experience of the user.

As the vehicle traverses through the water body in which it is operated the skimmer plate impinges on the water surface. This helps substantially in maintaining stability for it assists in keeping the leading foil more or less at the desired depth in the water. If the leading foil sinks too low then a greater reactive force is exerted by the water surface on the skimmer which tends to correct the situation. On the other hand if the leading foil tends to rise from the water then a restoring force is automatically exerted by gravity action which effectively rotates a leading end of the vehicle closer towards the water body.

The foils may be made in any appropriate way and, in one example of the invention, the foils are made from extruded sections for example of aluminium or a plastics material. The foils may have constant cross-sections or be formed with tapers. The foils are preferably hollow and are sealed at opposed ends by means of suitable plugs.

Another variation is to make use of a rudder to steer the vehicle, instead of, or if required, in addition to, pivoting one foil relatively to the other. For example, referring to FIG. 4, a hand or foot-controlled rudder 84 could be fixed at any suitable location to the support structure of the vehicle. By controlling the orientation of the rudder the vehicle can be steered.

What is claimed is:

1. A water vehicle comprising:

a leading first foil and a trailing second foil;

a support for said first and second foils, said first and second foils being at least partially submerged in water during operation of said water vehicle; and means securing said first and second foils to said support for movement in the water relative to each other, said movement of said first and second foils in the water relative to each other generating a thrust force for propelling said water vehicle through the water and a lifting force for supporting said water vehicle in the water.

2. The water vehicle of claim 1 wherein said relative foil movement is caused by at least one of the following: at least limited rotational movement of said first foil about an axis which is transverse to a longitudinal axis of said first foil and a variation in inclination of said first foil.

3. The water vehicle of claim 1 further including a water skimmer and means connecting said water skimmer for pivotal movement about an axis and to said first foil.

4. The water vehicle of claim 3 further including a third foil, said third foil being at least partly submersible and connected by said connecting means to said water skimmer.

5. The water vehicle of claim 1 further including biasing means, said biasing means acting to dampen said movement of said first and second foils relative to each other.

6. The water vehicle of claim 1 further including steering means usable to control the direction of movement of said water vehicle.

7. The water vehicle of claim 6 wherein said steering means includes a rudder.

8. The water vehicle of claim 6 wherein said steering means includes means for causing rotational movement of said first foil relative to said second foil.

9. A water vehicle comprising:

a support structure first and second foils supported by said support structure for at least partial submersion in water;

steering means for controlling the direction of movement of said water vehicle; and means for moving said first foil while submerged in the water, relative to said support structure to generate a thrust force for moving said water vehicle through the water and to generate a lifting force for supporting said water vehicle in the water.

10. The water vehicle of claim 9 wherein said steering means includes a rudder.

11. The water vehicle of claim 9 wherein said steering means includes means for causing rotational movement of said first foil relative to said second foil.

12. The water vehicle of claim 9 further including a skimmer, and means securing said skimmer to said first foil for movement with said first foil.

13. The water vehicle of claim 9 further including a third foil which is at least partially submersible and which is movable relative to at least one of said first and second foils.

14. The water vehicle of claim 9 wherein said support structure includes at least first and second movable sections, said movable sections permitting said movement of said first foil.

15. The water vehicle of claim 9 wherein said first and second foils are movable relative to each other to generate said forces for propelling, and for supporting said water vehicle.

16. A method of propelling a water vehicle through the water including:

providing a water vehicle having at least first and second foils;

at least partially submerging said at least first and second foils in a body of water;

repeatedly varying the inclination of each of said at least first and second foils while in the body of water; and generating a thrust force for propelling said water vehicle and a lifting force for supporting said water vehicle by said repeated varying of said inclination of each of said at least first and second foils.

17. The method of claim 16 further including varying the inclination of said first foil with respect to said second foil.

18. The method of claim 16 further including providing a skimmer, contacting the surface of the water with said skimmer, and using said skimmer to control a depth of submersion of said first foil in the body of water.

19. The method of claim 16 further including providing a third foil, at least partially submerging said third foil in the body of water, and repeatedly varying the inclination of said third foil while in the body of water.

20. The method of claim 16 including generating said force for propelling said water vehicle solely by repeatedly varying said inclination of said at least first and second foils.

21. The method of claim 20 further including supporting said water vehicle solely by said at least first and second foils as said water vehicle is propelled through the water.

* * * * *